US011585302B2

(12) United States Patent
Yoon et al.

(10) Patent No.: US 11,585,302 B2
(45) Date of Patent: Feb. 21, 2023

(54) FUEL PUMP MODULE

(71) Applicant: COAVIS, Sejong-si (KR)

(72) Inventors: Jong Hyuk Yoon, Sejong-si (KR); Ho Keun Yoon, Daejeon (KR)

(73) Assignee: COAVIS, Sejong-si (KR)

( * ) Notice: Subject to any disclaimer, the term of this patent is extended or adjusted under 35 U.S.C. 154(b) by 0 days.

(21) Appl. No.: 17/647,158

(22) Filed: Jan. 5, 2022

(65) Prior Publication Data

US 2022/0213854 A1 Jul. 7, 2022

(30) Foreign Application Priority Data

Jan. 5, 2021 (KR) ..... 10-2021-0000895

(51) Int. Cl.

| | |
|---|---|
| ***F02M 37/00*** | (2006.01) |
| ***F02M 37/44*** | (2019.01) |
| ***F02M 37/10*** | (2006.01) |
| ***F02M 37/50*** | (2019.01) |

(52) U.S. Cl.

CPC .... *F02M 37/0017* (2013.01); *F02M 37/0011* (2013.01); *F02M 37/0047* (2013.01); *F02M 37/103* (2013.01); *F02M 37/106* (2013.01); *F02M 37/44* (2019.01); *F02M 37/50* (2019.01)

(58) Field of Classification Search

CPC ..... F02M 37/0017; F02M 37/0047; F02M 37/10; F02M 37/103; F02M 37/106; F02M 37/44; F02M 37/50

See application file for complete search history.

(56) References Cited

U.S. PATENT DOCUMENTS 4,933,079 A * 6/1990 Kroha ..... B01D 35/02 210/232
5,658,023 A * 8/1997 Mercer ..... F02M 37/32 210/232
5,832,589 A * 11/1998 Mercer ..... F02M 37/32 210/232

(Continued)

FOREIGN PATENT DOCUMENTS

DE 102015007466 A1 * 12/2015 ..... F02M 37/0023
JP 2001208265 A * 8/2001

(Continued)

OTHER PUBLICATIONS

Korean Intellectual Property Office, Notice of Allowance Issued in Application No. 2021-0000895, dated Oct. 17, 2022, 9 pages. (Submitted with Partial Translation).

*Primary Examiner* — John M Zaleskas
(74) *Attorney, Agent, or Firm* — McCoy Russell LLP

(57) ABSTRACT

The present disclosure relates to a fuel pump module, and more particularly, to a fuel pump module including a flange module and a reservoir module, in which when a fuel delivery pipe for supplying filtered fuel from the reservoir module to the flange module is coupled to the reservoir module, since the fuel deliver pipe may be coupled to the reservoir module to a desired position in an axial direction and to be prevented from rotating in an axial direction, the fuel delivery pipe may be prevented from interfering with a guide rod connecting the flange module and the reservoir module in a vertical direction, thereby not only preventing the occurrence of fire, but also increasing a common use rate of the reservoir module.

2 Claims, 5 Drawing Sheets

(56) References Cited

U.S. PATENT DOCUMENTS 5,961,293 A * 10/1999 Clemmons ..... F02M 37/10 417/423.3
6,293,770 B1 * 9/2001 Matsumoto ..... F02M 37/106 417/313
2002/0053567 A1 * 5/2002 Beyer ..... F02M 37/0017 220/4.14
2004/0112819 A1 * 6/2004 Ebihara ..... F02M 37/106 416/4
2005/0011557 A1 * 1/2005 Yoshioka ..... F02M 37/103 137/571
2008/0191467 A1 * 8/2008 Zeitlinger ..... F16L 37/098 285/33
2009/0120413 A1 * 5/2009 Ramamurthy ..... F02M 37/0029 123/511
2011/0168134 A1 * 7/2011 Lim ..... F02M 37/106 123/509
2012/0060949 A1 * 3/2012 Okazono ..... F02M 37/103 137/565.17
2016/0252060 A1 * 9/2016 Niwa ..... F02M 37/50 137/544
2018/0119859 A1 * 5/2018 Lee ..... F02M 37/00

FOREIGN PATENT DOCUMENTS

JP 2005127394 A * 5/2005 ..... F16L 37/0982
JP 2008080295 A * 4/2008
JP 2010216391 A * 9/2010
JP 2010216391 A 9/2010
JP 2011099425 A * 5/2011 ..... B01D 35/30
JP 2015182688 A 10/2015
KR 101021516 B1 * 3/2011 ..... B01D 35/30
KR 101021516 B1 3/2011
KR 20110044647 A * 4/2011 ..... B01D 35/30
KR 101222010 B1 2/2013
KR 101866356 B1 7/2018

* cited by examiner

230 : 231, 232
232 : 232-1, 232-2, 232-3
410 : 411, 412

230 : 231, 232
232 : 232-1, 232-2, 232-3, 232-4
410 : 411, 412

230 : 231, 232
232 : 232-1, 232-2, 232-3
410 : 411, 412

FUEL PUMP MODULE

CROSS REFERENCE TO RELATED APPLICATION

The present application claims priority to Korean Patent Application No. 10-2021-0000895 filed on Jan. 5, 2021. The entire contents of the above-listed application is hereby incorporated by reference for all purposes.

TECHNICAL FIELD

The present disclosure relates to a fuel pump module, and more particularly, to a fuel pump module including a flange module and a reservoir module, in which when a fuel delivery pipe for supplying filtered fuel from the reservoir module to the flange module is coupled to the reservoir module, since the fuel delivery pipe may be coupled to the reservoir module to be prevented from rotating in an axial direction at a desired position in the axial direction, the fuel delivery pipe may be prevented from interfering with a guide rod connecting the flange module and the reservoir module in a vertical direction, thereby not only preventing the occurrence of a fire, but also increasing a common use rate of the reservoir module.

BACKGROUND

FIG. 1 is a diagram illustrating a conventional fuel pump module.

Referring to FIG. 1, the fuel pump module is configured to filter fuel stored in a fuel tank and then deliver the filtered fuel to an engine side, and largely includes a flange module 11 that coupled and fixed to the fuel tank, a fuel pump that is positioned on a lower side of the flange module 11 to be spaced apart by a guide rod 13 and sucks and discharges fuel, and a reservoir module 12 having a built-in component such as a filter for filtering the fuel.

The reservoir module 12 is supported by the guide rod 13 and may include elastic means to adjust a separation distance between the flange module 11 and the reservoir module 12 by an external force. In addition, the reservoir module 12 includes a filter part 12-1 provided with a filter, and the filter part 12-1 may be connected to the flange module 11 through a fuel delivery pipe 14 through which fuel is delivered to the flange module 11 to filter the fuel supplied from the fuel pump and then supply the fuel to the flange module 11 through the fuel delivery pipe 14.

In this case, depending on features of the fuel tank, a position of the flange module 11 may be formed in various directions without facing the reservoir module 12, and a distance between the flange module 11 and the reservoir module 12 may be reduced according to a size of the fuel tank. Accordingly, a coupling direction and a coupling position between the flange module 11 and the reservoir module 12 to which the fuel delivery pipe is connected may be changed, and thus, the fuel delivery pipe 14 may rotate in an axial direction at a coupling site with the reservoir module 12, so the fuel delivery pipe 14 and the guide rod 13 may come into contact and interfere with reach other.

As a result, the fuel delivery pipe 14 continuously interferes with the guide rod 13, and thus, the fuel delivery pipe 14 and the guide rod 13 may be damaged or broken, and the fuel delivery pipe 14 continuously interferes with the guide rod 13 formed of a conductor, and thus, a fire may occur.

In addition, in order to prepare for the above-mentioned damage or breakage and the risk of the occurrence of fire, it is necessary to form a fuel pump module to be applied to each fuel tank having various shapes and sizes, so the common use rate is reduced, and R&D and manufacturing costs for manufacturing the fuel pump module increase.

RELATED ART DOCUMENT

Patent Document

Korean Patent Publication No. 10-1222010 (Jan. 8, 2013)

SUMMARY

An object of the present disclosure provides a fuel pump module including a flange module and a reservoir module, in which when a fuel delivery pipe for supplying filtered fuel from the reservoir module to the flange module is coupled to the reservoir module, the fuel delivery pipe may be coupled to the reservoir module to be prevented from rotating in an axial direction at a desired position in the axial direction.

According to an aspect of the present disclosure, a fuel pump module includes: a flange module 100 including a flange module body 110 that is coupled to a fuel tank, and a supply port 120 that is formed on the flange module body 110 to supply fuel to an engine side; a reservoir module 200 including a reservoir body 210 that is formed on a lower side of the flange module 100 and has a fuel pump built therein, a fuel pump mounting part 220 that is coupled to an upper side of the reservoir body 210 to fix the fuel pump, and a filter part 230 that filters fuel supplied from the fuel pump; a guide rod 300 supporting and fixing the flange module 100 and the reservoir module 200; and a fuel delivery pipe 400 having one side connected to the supply port 120 and the other side coupled to the filter part 230 to deliver the fuel from the filter part 230 to the supply port 120, in which the fuel delivery pipe 400 is coupled to the filter part 230, and is coupled to be prevented from rotating in an axial direction through coupling of a protrusion and a groove.

The filter part 230 may include a filter part body 231 having a built-in filter paper, an inlet through which fuel is supplied to the filter part body 231, and a supply part 232 protruding from the filter part body 231, and being connected to the other side of the fuel delivery pipe 400 to supply the fuel, and the supply part 232 includes a supply part body 232-1 into which the other side of the fuel delivery pipe 400 is insertable, and at least one anti-rotation protrusion 232-2 protruding from the supply part body 232-1 in the insertion direction of the fuel delivery pipe 400.

The fuel delivery pipe 400 may include an anti-rotation body 411 formed to have a certain area in a radial direction at a selected position on the other side, and a fuel delivery pipe coupling part 410 including an anti-rotation groove 412 that is cut in the axial direction corresponding to the anti-rotation protrusion 232-2 so that the anti-rotation protrusion 232-2 is inserted into the anti-rotation body 411.

The supply part 232 may include a through part 232-3 formed to be penetrated at a selected position on a side of the coupling part body 232-1, and a clip-shaped clip means 232-4 inserted through the through part 232-3 to fix the fuel delivery pipe 400.

The anti-rotation protrusion 232-2 may include a position displacement extension **232-2*a* formed to extend from an end in a direction of a center of the fuel delivery pipe 400**.

According to the present disclosure, in a fuel pump module for supplying fuel from a reservoir module to a flange module through a fuel delivery pipe, since the fuel deliver pipe may be coupled to the reservoir module to a desired position in an axial direction and to be prevented from rotating in an axial direction, the fuel delivery pipe may be prevented from interfering with a guide rod supporting the flange module and the reservoir module due to the contact with the guide rod, thereby not only preventing the fuel delivery pipe or the guide rod from being damaged and broken.

In addition, since the fuel pump module according to the present disclosure may prevent continuous interference between the guide rod formed of a conductor and the fuel delivery pipe, there is an advantage in preventing the occurrence of a fire due to the interference.

In addition, since the fuel pump module according to the present disclosure may prevent the fuel delivery pipe from interfering with the guide rod even when applied to various sizes and shapes, there is an advantage in that the common use rate of the reservoir module may increase.

In addition, since the fuel pump module according to the present disclosure may increase the common use rate of the reservoir module, there is an advantage that may reduce R&D and manufacture costs for application to a fuel tank of various sizes and shapes.

DETAILED DESCRIPTION

A fuel pump module according to an embodiment of the present disclosure will be described in detail with reference to the accompanying drawings.

Figure 1:
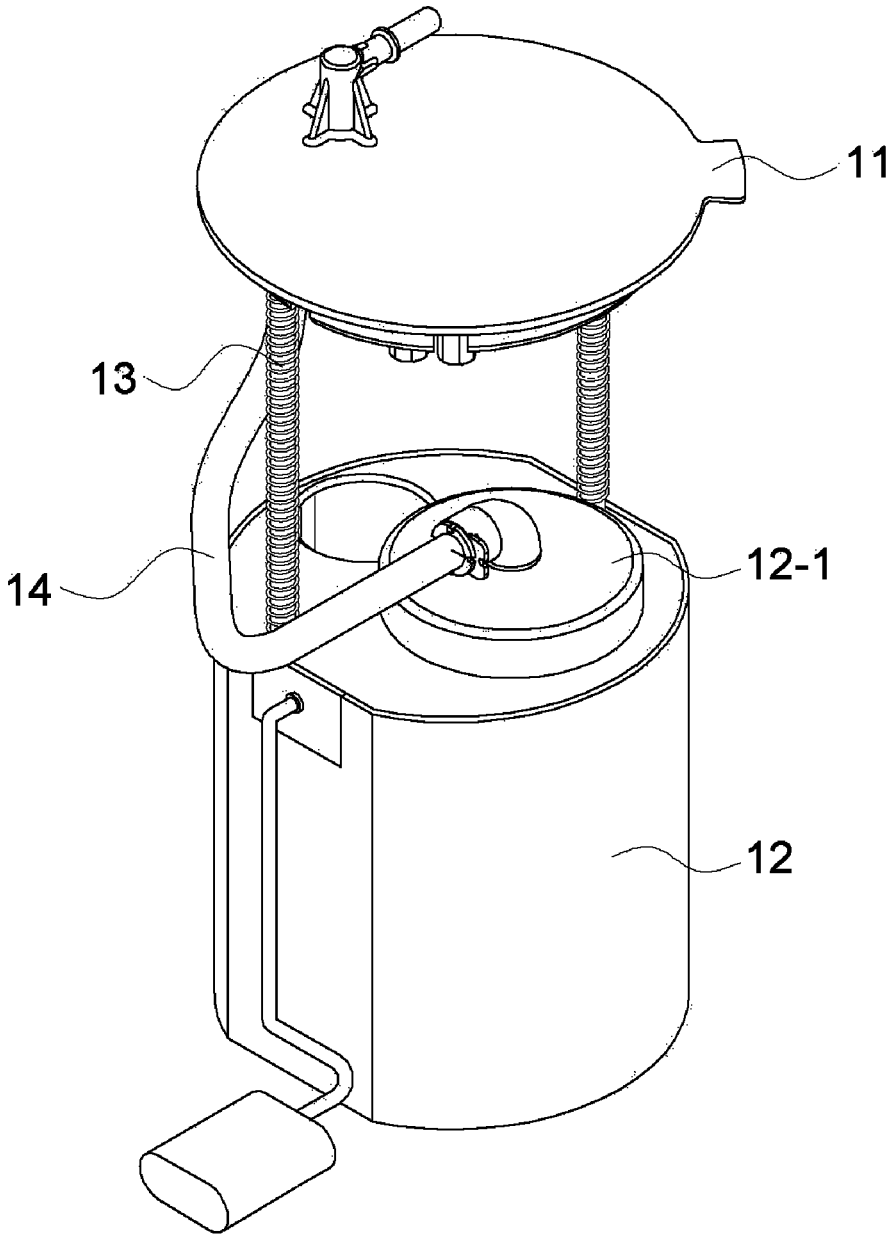
FIG. 1 PRIOR ART
FIG. 1 is a diagram illustrating a conventional fuel pump module.
Figure 2:
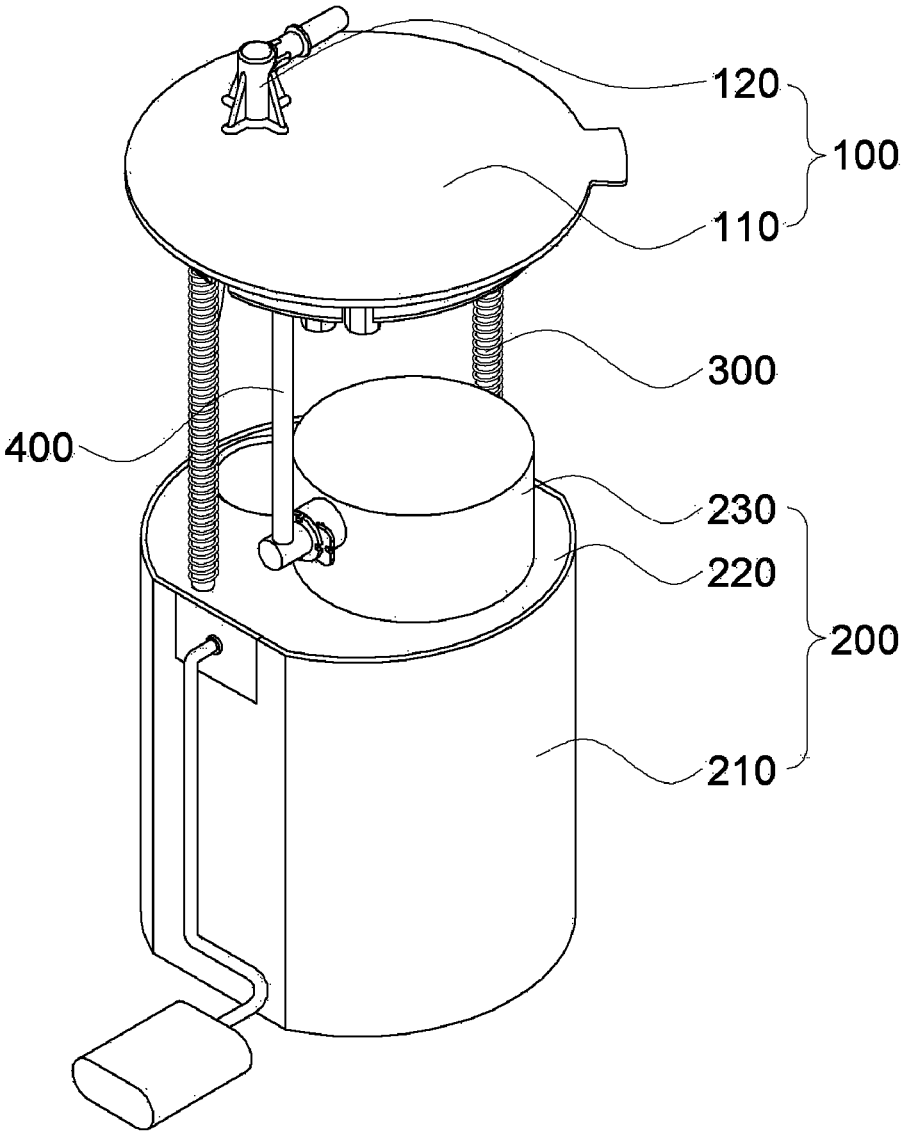
FIG. 2 is a perspective view of a fuel pump module according to an embodiment of the present disclosure.
Figure 3:
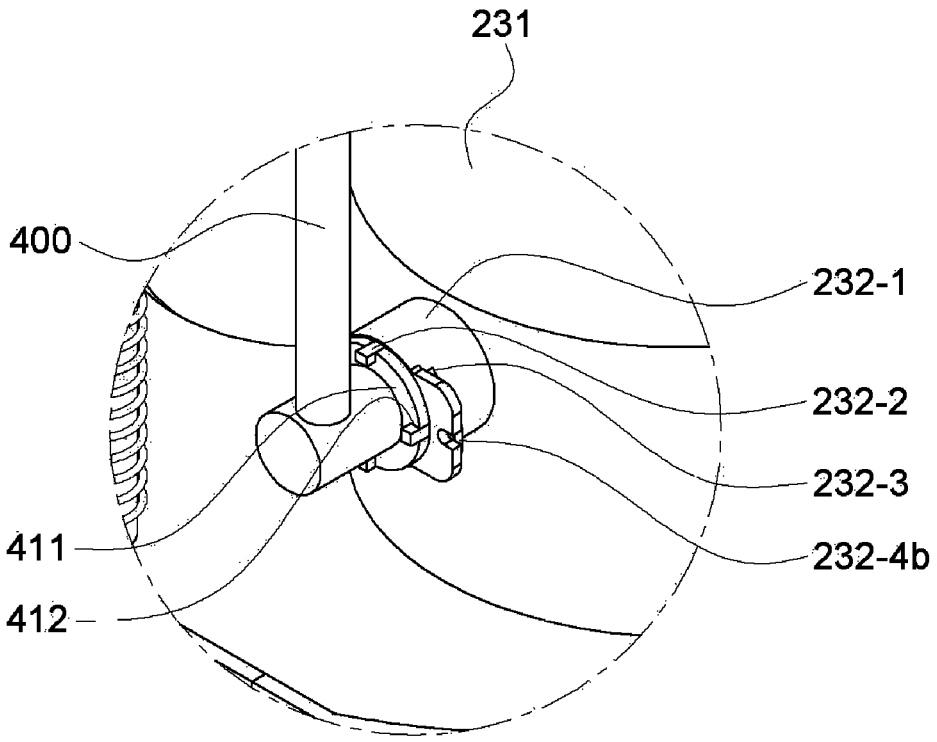
FIG. 3 is a partial perspective view of the fuel pump module according to the embodiment of the present disclosure.
Figure 4:
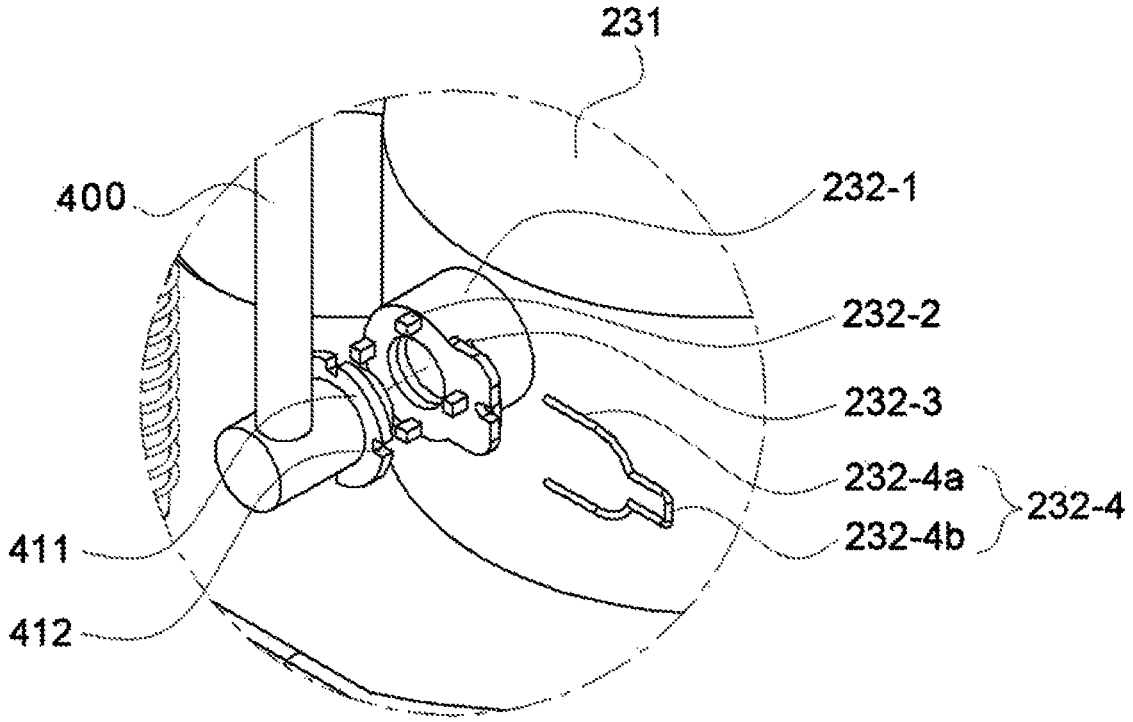
FIG. 4 is another partial perspective view of the fuel pump module according to the embodiment of the present disclosure.
Figure 5:
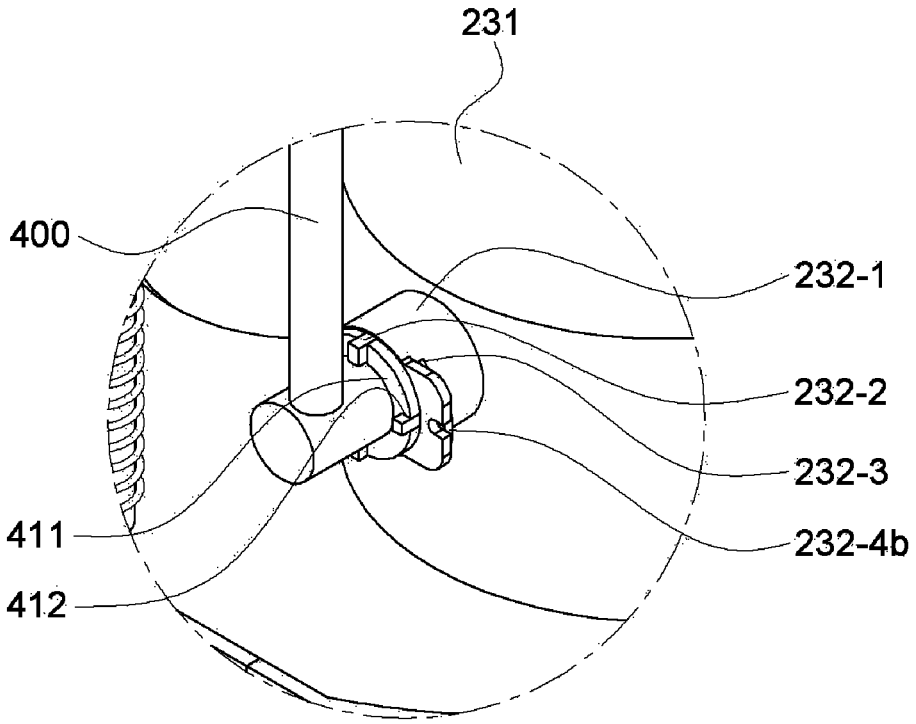
FIG. 5 is another partial perspective view of the fuel pump module according to the embodiment of the present disclosure.

FIG. 2 is a perspective view of a fuel pump module according to an embodiment of the present disclosure, FIG. 3 is a partial perspective view of the fuel pump module according to the embodiment of the present disclosure, FIG. 4 is another partial perspective view of the fuel pump module according to the embodiment of the present disclosure, and FIG. 5 is another partial perspective view of the fuel pump module according to the embodiment of the present disclosure.

Referring to FIGS. 2 to 4, a fuel pump module according to an embodiment of the present disclosure includes a flange module 100, a reservoir module 200 that is fixed to a lower side of the flange module 100, a guide rod 300 that connects the flange module 100 and the reservoir module 200, and a fuel delivery pipe 400 that delivers filtered fuel from the reservoir module 200 to the flange module 100.

The flange module 100 includes a flange module body 110 that is fixed to a fuel tank and a supply port 120 that is formed on an upper side of the flange module body 110 to be supplied with fuel sucked and filtered from an inside of the fuel tank and supply the fuel to an engine side.

The flange module body 110 is fixed to a selected position of the fuel tank, and generally has a disk shape but may be formed in various shapes. The supply port 120 protrudes upward of the flange module body 110 and is connected to a fuel transfer line for transferring fuel to the engine, and is connected to the fuel delivery pipe 400 that is under the flange module body 110 and is supplied with the fuel transferred from the reservoir module 200.

In addition, the flange module 100 may be formed with a valve or the like that may regulate a pressure inside the fuel tank.

The reservoir module 200 is inserted into the fuel pump on the lower side of the flange module 100 by the guide rod 300, and includes a reservoir body 210, a fuel pump mounting part 220, and a filter part 230.

The reservoir body 210 is a basic body of the reservoir module 200. The reservoir body 210 may be formed in a shape in which an upper side thereof is opened together with a space formed inside thereof so that the reservoir body 210 may have fuel sucked thereinto and have components, such as the fuel pump constituting the reservoir module 200, built therein.

The fuel pump mounting part 220 is coupled to the upper side of the reservoir body 210, and may be coupled and fixed to the fuel pump. In addition, the fuel pump mounting part 220 includes a configuration in which fuel is discharged to the upper side thereof.

The filter part 230 is formed in the fuel pump mounting part 220, filters the fuel supplied from the fuel pump, and is formed to transfer fuel to the flange module through the fuel delivery pipe 400 having one side and the other side connected to the supply port 120 of the flange module 100 and the filter part 230.

The filter part 230 includes a filter part body 231 having a built-in filter paper for filtering fuel supplied from the fuel pump, an inlet (not illustrated) through which fuel is supplied to the filter part body 231, and a supply part 232 formed to supply fuel by connecting the filter part body 231 and the other side of the fuel delivery pipe 400.

Since other components constituting the above-described flange module 100 and reservoir module 200 are known techniques, detailed descriptions thereof will be omitted.

As described above, the guide rod 300 is formed to connect the flange module 100 and the reservoir module 200 and may include an elastic means. At least one guide rod 300 may have one side connected to the lower side of the flange module body 110 of the flange module 100, and the other side supported and coupled to the reservoir body 210 of the reservoir module 200.

The guide rod 300 is formed of a conductor and includes an elastic means, thereby applying a force to at least one of the flange module 100 and the reservoir module 200 in a selected direction to adjust a separation distance between the flange module 100 and the reservoir module 200.

In this case, in the fuel pump module according to the embodiment of the present disclosure, the other side of the fuel delivery pipe 400 is inserted and coupled to the supply part 232 of the filter part 230 to prevent the fuel delivery pipe 400 from rotating in the axial direction.

Describing in more detail, the supply part 232 includes a supply part body 232-1 whose inside is hollow so that the other side of the fuel delivery pipe 400 can be inserted, and at least one anti-rotation protrusion 232-2 protruding from the supply part body 232-1 in an insertion direction of the fuel delivery pipe 400.

The fuel delivery pipe 400 may include an anti-rotation body 411 formed to have a certain area in a radial direction at a selected position on the other side and facing an end of the supply part body 232-1, and a fuel delivery pipe coupling part 410 including an anti-rotation groove 412 that is cut in the axial direction corresponding to the anti-rotation protrusion 232-2 so that the anti-rotation protrusion 232-2 is inserted into the anti-rotation body 411.

That is, in the fuel pump module according to an embodiment of the present disclosure, by making the anti-rotation body 411 face the supply part body 232-1 so that the other side of the fuel delivery pipe 400 is inserted into the supply part body 232-1 for coupling between the fuel delivery pipe 400 and the filter part 230, and the anti-rotation protrusion 232-2 is inserted into the anti-rotation groove 412 formed on the other side of the fuel delivery pipe 400, the fuel delivery pipe 400 may be prevented from rotating in the axial direction by the anti-rotation groove 412 and the anti-rotation protrusion 232-2.

In addition, the plurality of anti-rotation protrusions 232-2 may be spaced apart from each other by a certain distance in the circumferential direction to correspond to the supply part body 232-1, and more preferably, the anti-rotation protrusions 232-2 may be formed in at least four or more. The plurality of anti-rotation grooves 412 coupled to the anti-rotation protrusion 232-2 may also be spaced apart from each other in the circumferential direction corresponding to the anti-rotation protrusion 232-2, and more preferably, the anti-rotation grooves 412 may be formed in four or more so that the selected anti-rotation protrusion 232-2 and anti-rotation groove 412 are coupled to each other.

That is, the plurality of anti-rotation protrusions 232-2 formed at a fixed position are formed in the supply part body 232-1 while spaced apart by a certain distance in the circumferential direction, and the plurality of anti-rotation grooves 412 formed in response thereto are also spaced apart in the circumferential direction, so a user rotates the anti-rotation body 411 of the fuel delivery pipe 400 rotatable in the circumferential direction, thereby coupling the selected anti-rotation groove 412 and anti-rotation protrusion 232-2.

By doing so, the fuel delivery pipe 400 may be prevented from rotating in the axial direction, and may be coupled to the supply part 232 in a direction selected among the circumferential directions of the fuel delivery pipe 400.

That is, even if the flange module 100 is formed at various positions of the fuel tank and the coupling direction and the position direction are changed, the fuel delivery pipe 400 may be coupled to the filter part 230 in a desired circumferential direction in response to this to prevent the fuel delivery pipe 400 from rotating in the axial rotation to prevent the fuel delivery pipe 400 from contacting and interfering with the guide rod 300, so it is possible to not only prevent the fuel delivery pipe 400 and the guide rod 300 from being damaged and broken, but also prevent the occurrence of a fire due to the interference with the guide rod 300 formed of a conductor.

In other words, since the fuel delivery pipe 400 may be prevented from coming into contact with the guide rod 300 even at various formation positions of the flange module 100 and at various separation distances between the flange module 100 and the reservoir module 200, the reservoir module 200 may be commonly used and applied to fuel tanks having various shapes and sizes, thereby increasing the common use rate of the reservoir module 200.

Accordingly, the need to separately design and manufacture the reservoir module 200 according to the fuel tanks having various shapes and sizes is reduced, thereby reducing R&D and manufacturing costs.

In this case, the plurality of anti-rotation protrusions 232-2 and the plurality of anti-rotation grooves 412 may be formed at regular intervals, and more preferably, four anti-rotation protrusions 232-2 and anti-rotation grooves 412 are formed at intervals of 90° to adjust the coupling position at intervals of 90°. However, six anti-rotation protrusions and anti-rotation grooves are formed for more precise adjustment of the coupling position and are adjusted at intervals of 60° or more, but are not limited thereto.

In addition, since the anti-rotation protrusion 232-2 extends from the end of the supply part body 232-1, and thus, may serve as a guide when the other side of the fuel delivery pipe 400 is coupled to the supply part 232 by the insertion into the supply part 232, so it is possible for a worker to easily insert the other side of the fuel delivery pipe 400 into the supply part 232 according to the maintenance and replacement of the fuel pump of the reservoir module 200.

In addition, the anti-rotation body 411 of the fuel delivery pipe coupling part 410 is formed equal to or larger than the supply part body 232-1 of the supply part 232, so when the other end of the fuel delivery pipe 400 is coupled by the insertion into the supply part 232, the fuel delivery pipe 400 faces the supply part body 232-1, and thus, may act as a stopper to adjust the insertion length in addition to perform the safe coupling.

In addition, the supply part 232 is preferably formed in a horizontal direction from the filter part body 231 to prevent easy coupling with the fuel delivery pipe 400 and the displacement of the position. In addition, the fuel delivery pipe 400 is preferably formed by bending the other side to be positioned in the horizontal direction for ease of coupling with the supply part 232 formed in the horizontal direction.

In addition, the other side of the fuel delivery pipe 400 bent in the horizontal direction is preferably formed to have certain rigidity for easy coupling with the supply part 232.

The supply part 232 may further include a through part 232-3 which is formed to be penetrated at a selected position on the side of the coupling part body 232-1, and the coupling part may further include a clip means 232-4 inserted into the through part 232-3 to prevent the position of the fuel delivery pipe 400 from being displaced.

The clip means 232-4 may have a clip shape that is opened in one direction, and includes clip fixing parts **232-4*a* facing each other and a handle part 232-4*b* in which one side of the clip fixing parts 232-4*a* is coupled to each other and the clip fixing parts 232-4*a*** have an open shape only in the insertion direction.

That is, the clip means 232-4 is inserted and fixed in the opened direction through the through part 232-3 so that the clip fixing part **232-4*a* surrounds both directions of the fuel delivery pipe 400, and the handle part 232-4*b* cannot move in the insertion direction of the fuel delivery pipe 400 by the through part 232-3, so it is possible to prevent the position of the fuel delivery pipe 400 coupled to the supply part 232** from being displaced due to the delivery of fuel, vibration, or the like.

The clip means 232-4 is inserted and coupled to the fuel delivery pipe 400 through the pressure of the clip fixing part **232-4*a*, thereby preventing the position of the fuel delivery pipe 400** from being displaced.

In addition, one more through part 232-3 may be formed in the opposite direction. Through this, the through part 232-3 is configured in a pair in both directions, so the end of the clip fixing part **232-4*a* may be exposed. Through this, it is preferable to check whether the clip means 232-4** is properly coupled.

Referring to FIG. 5, the anti-rotation protrusion 232-2 may further include a position displacement extension 232-2*a* formed to extend from the end toward the center of the fuel delivery pipe (400).

That is, when the supply part 232 and the fuel delivery pipe 400 are coupled, the anti-rotation protrusion 232-2 is inserted into the anti-rotation groove 412 to prevent the fuel delivery pipe 400 from rotating in the axial direction. In addition, by allowing the position displacement extension 232-2*a* to surround a part of the anti-rotation body 411, it is possible to prevent the position of the fuel delivery pipe 400 from being displaced due to the supply of fuel, vibration, or the like.

In this case, since the position displacement extension 232-2*a* should be inserted and coupled to the anti-rotation body 411, it is preferable that the position displacement extension 232-2*a* is made of a plastic resin material having a certain elasticity or ductility, and thus, is formed to be an interference fit.

DETAILED DESCRIPTION OF MAIN ELEMENTS

| | |
|---|---|
| 100: Flange module | |
| 110: Flange module body | |
| 120: Supply port | |
| 200: Reservoir module | |
| 210: Reservoir body | |
| 220: Fuel pump mounting part | |
| 230: Filter part | |
| 231: Filter part body | 232: Supply part |
| 232-1: Supply part body | 232-2: Anti-rotation protrusion |
| 232-3: Through part | 232-4: Clip means |
| 232-4a: Clip fixing part | 232-4b: Handle part |
| 300: Guide rod | |
| 400: Fuel delivery pipe | |
| 410: Fuel delivery pipe coupling part | |
| 411: Anti-rotation body | |
| 412: Anti-rotation groove | |

The invention claimed is:

1. A fuel pump module, comprising:

a flange module including a flange module body that is coupled to a fuel tank, and a supply port that is formed on the flange module body to supply fuel to an engine side;

a reservoir module including a reservoir body that is formed on a lower side of the flange module and has a fuel pump built therein, a fuel pump mounting part that is coupled to an upper side of the reservoir body to fix the fuel pump, and a filter part that filters fuel supplied from the fuel pump;

a guide rod supporting and fixing the flange module and the reservoir module; and a fuel delivery pipe having one side connected to the supply port and an other side coupled to the filter part, wherein the filter part includes:

a filter part body having a built-in filter paper;

an inlet through which fuel is supplied to the filter part body; and a supply part protruding from the filter part body, and being connected to the other side of the fuel delivery pipe to supply the fuel, and wherein the supply part includes:

a supply part body into which the other side of the fuel delivery pipe is insertable; and at least one anti-rotation protrusion protruding from the supply part body in an insertion direction of the fuel delivery pipe, wherein the supply part further includes:

a first through part formed on a side surface of the supply part body;

a second through part formed on a side opposite to the side on which the first through part is formed; and a clip inserted through the first through part to fix the fuel delivery pipe, wherein the clip is extended so that an inserted side end is exposed to the second through part, wherein the fuel delivery pipe includes:

an anti-rotation body formed to have a certain area in a radial direction at a selected position on the other side; and a fuel delivery pipe coupling part including, for each of the at least one anti-rotation protrusion, an anti-rotation groove that is cut in an axial direction corresponding to the anti-rotation protrusion so that the anti-rotation protrusion is inserted into the anti-rotation body, and wherein each of the at least one anti-rotation protrusion includes a position displacement extension extending from a protruding end of the anti-rotation protrusion in a direction of a center of the fuel delivery pipe.

2. The fuel pump module of claim 1, wherein the fuel pump module includes a plurality of anti-rotation protrusions and a plurality of anti-rotation grooves, wherein each of the pluralities of anti-rotation protrusions and anti-rotation grooves are spaced apart from each other by a certain distance in a circumferential direction.

* * * * *